US007980501B2

(12) United States Patent
Ueda

(10) Patent No.: US 7,980,501 B2
(45) Date of Patent: Jul. 19, 2011

(54) BUCKET TYPE JAW CRUSHER

(75) Inventor: Toshiharu Ueda, Osaka (JP)

(73) Assignee: Ueda Industries Co., Ltd., Osaka (JP)

( * ) Notice: Subject to any disclaimer, the term of this patent is extended or adjusted under 35 U.S.C. 154(b) by 0 days.

(21) Appl. No.: 12/733,331

(22) PCT Filed: Sep. 3, 2008

(86) PCT No.: PCT/JP2008/002413

§ 371 (c)(1),
(2), (4) Date: Feb. 24, 2010

(87) PCT Pub. No.: WO2009/031296

PCT Pub. Date: Mar. 12, 2009

(65) Prior Publication Data

US 2010/0206975 A1 Aug. 19, 2010

(30) Foreign Application Priority Data

Sep. 3, 2007 (JP) ..... 2007-227404

(51) Int. Cl.
*B02C 1/06* (2006.01)

(52) U.S. Cl. ..... 241/268; 241/101.73

(58) Field of Classification Search ..... 241/101.73, 241/264–269

See application file for complete search history.

(56) References Cited

U.S. PATENT DOCUMENTS 7,614,573 B1 * 11/2009 Jean ..... 241/264

FOREIGN PATENT DOCUMENTS

| | | |
|---|---|---|
| JP | 5-131153 | 5/1993 |
| JP | 5-88636 | 12/1993 |
| JP | 8-21108 | 1/1996 |
| JP | 8-150344 | 6/1996 |
| JP | 10-137604 | 5/1998 |
| JP | 2003-164769 | 6/2003 |
| JP | 2004-167443 | 6/2004 |
| JP | 2005-342610 | 12/2005 |
| JP | 2007-117931 | 5/2007 |
| JP | 2007-185567 | 7/2007 |

OTHER PUBLICATIONS

Microfilm of the specification and drawings annexed to the request of Japanese Utility Model Application No. 15345/1974 (Laid-open No. 106172/1975) (Sekigahara Seisakusho, Ltd.) Sep. 1, 1975, Fig. 1 (Family: none).

* cited by examiner

*Primary Examiner* — Mark Rosenbaum
(74) *Attorney, Agent, or Firm* — Jordan and Hamburg LLP

(57) ABSTRACT

A bucket type jaw crusher comprises a hydraulic motor connected to one end of an eccentric main shaft, a flywheel connected to the other end of the eccentric main shaft, and a counterweight for balance adjustment fitted at an intermediate section of the eccentric main shaft between the hydraulic motor and the flywheel. A movable jaw teeth side load receiving section of a toggle plate is placed at an upper position than a bucket side load receiving section of the toggle plate, and while movable jaw teeth are reciprocated by rotation of the eccentric shaft, an object to be crushed is pressed against stationary jaw teeth by the movable jaw teeth via rocking motion of the toggle plate.

10 Claims, 12 Drawing Sheets

BUCKET TYPE JAW CRUSHER

BACKGROUND OF THE INVENTION

The present invention relates to a bucket type jaw crusher for processing waste materials such as waste concrete, waste building material, and waste pavement material.

Conventionally in this kind of jaw crusher, as shown in FIG. 1 of Patent Document 1, a toggle plate 30 supporting movable jaw teeth 20 is installed with a state inclined downward toward its tip relative to the movable jaw teeth, and the movable jaw teeth reciprocates in the direction of lifting the toggle plate at the time of crushing. At this time, the reciprocating motion of the movable jaw teeth is supported by load receiving sections 21 on the upper and lower portions of the toggle plate. Because lubricating oil must be constantly supplied to lubricate the upper and lower load faces of the toggle plate, an oil pump is installed.

As the teeth plate of stationary jaw teeth, one having a vertically linear shape is used. As the teeth plate of movable jaw teeth, one having a vertically linear shape or a gentle arc shape is used. Regarding a tension rod 22, the length of the tension rod is increased so that the inclination angle of the tension rod will not change much even if an exit space 72 between the movable jaw teeth and the stationary jaw teeth is adjusted to reciprocate the movable jaw teeth. The toggle plate supports the bottom of the movable jaw teeth in a state inclined downward toward its tip. A similar constitution is described in Patent Document 2 as well.

Patent Document 1: Japanese Laid-Open Utility Model Publication H5-88636

Patent Document 2: Japanese Laid-Open Patent Publication H8-150344

Conventionally in this kind of jaw crusher, a toggle plate supporting movable jaw teeth is installed with a state inclined downward toward its tip relative to the movable jaw teeth, and because the movable jaw teeth reciprocates in the direction of lifting the toggle plate at the time of crushing, there is the deficiency that crushing power is weak and crushing into fines is difficult. In addition, the load receiving sections on the top and bottom of the toggle plate supporting the reciprocating motion of the movable jaw teeth wear out rapidly, the number of replacing them is large depending on the frequency of their use, and the jaw crusher needs to be disassembled and reassembled in order to perform replacement of those load receiving sections, with the deficiency that there is an increase in labor and downtime.

Because the load faces on the top and bottom of the toggle plate must be constantly lubricated with a lubricating oil, an oil pump needs to be installed, with the deficiency that piping and maintenance require some labor. While as the teeth plate of conventional stationary jaw teeth, one having a vertically linear shape is used, and as the teeth plate of movable jaw teeth, one having a vertically linear shape or a gentle arc shape is used, if the stationary jaw teeth and movable jaw teeth are arranged in a V shape, there are such shortcomings as a large gripping angle, poor crushing performance, and the necessity of separate spare teeth plates.

While the length of the conventional tension rod was increased so that the inclination angle of the tension rod would not change much even if the exit space between the movable jaw teeth and the stationary jaw teeth is adjusted to reciprocate the movable jaw teeth, which caused the shortcoming that the space occupied by the tension rod and a spring increases.

Because the conventional toggle plate supports the bottom of movable jaw teeth in a state inclined downward toward its tip, even if a bucket is inverted to remove clogging of crushed objects, the toggle plate hinders securing enough space between the movable jaw teeth and the stationary jaw teeth, with the deficiency that the clogging of crushed objects could not be fully resolved.

SUMMARY OF THE INVENTION

An objective of the invention is to provide a bucket type jaw crusher which can perform strong crushing into fines within a short time. Another objective of the invention is to provide a bucket type jaw crusher which allows quick and easy replacement of the load receiving sections of the toggle plate and easy lubrication of the toggle plate.

In addition, another objective of the invention is to provide a bucket type jaw crusher which improves gripping and grinding of crushed objects and requires only one spare teeth plate. In addition, another objective of the invention is to provide a bucket type jaw crusher which can quickly respond to changes in the tension rod inclination while movable jaw teeth are in operation.

In addition, another objective of the invention is to provide a bucket type jaw crusher which can quickly remove crushed objects clogging the space between movable jaw teeth and stationary jaw teeth. Furthermore, another objective of the invention is to provide a bucket type jaw crusher which provides a counterweight between a hydraulic motor and a flywheel to improve the crushing speed.

The present invention relates to a bucket type jaw crusher for attaching to a hydraulic shovel arm, which has a stationary jaw teeth fixed to an inner surface of a bottom of a bucket, a movable jaw teeth opposing the stationary jaw teeth forming a V shape together with the stationary jaw teeth, a toggle plate supporting a lower portion of the movable jaw teeth, an eccentric main shaft rotatably supporting an upper portion of the movable jaw teeth, and a rotational driving means which rotationally drives the eccentric main shaft, and is capable of crushing an object to be crushed with the movable jaw teeth reciprocated via the eccentric main shaft by the rotational driving means and the stationary jaw teeth.

A hydraulic motor provided as the rotational driving means is connected to one end of the eccentric main shaft and a flywheel connected to the other end of the eccentric main shaft are provided, and a counterweight for balance adjustment is provided at an intermediate portion of the eccentric main shaft between the hydraulic motor and the flywheel.

A movable jaw teeth side load receiving section of the toggle plate is placed at an upper position than a bucket side load receiving section of the toggle plate, and while the movable jaw teeth are reciprocated by the rotation of the eccentric main shaft, the object to be crushed is pressed against the stationary jaw teeth by the movable jaw teeth via the rocking motion of the toggle plate.

In the bucket type jaw crusher of the present invention, while moving the movable jaw teeth in the direction of pressing the object to be crushed from the upper position to the lower position, the toggle plate supporting the lower portion of the movable jaw teeth which is placed differently from a conventional one so that the movable jaw teeth side load receiving section is placed at an upper position than the bucket side load receiving section, which enables crushing the object to be crushed strongly into fines by receiving a reaction of the toggle plate at the time of its rocking motion. In addition, because a counterweight is provided on the eccentric main shaft between the hydraulic motor and the flywheel, the unbalanced moment and inertial force exerting on the eccentric shaft during reciprocating motion of the movable jaw teeth can be balanced, providing improvement on the crushing speed.

To the present invention, the following constitution may be adopted in addition to the constitution described above.

(1) A plurality of grease supply holes including check valves are provided in the toggle plate, which respectively communicate with an upper end load surface and a lower end load surface of the toggle plate, so that grease can be supplied from the grease supply holes onto the upper and lower load faces. Therefore, supplying grease to the toggle plate can be performed directly by a grease gun, which eliminates the need for a pump or piping and facilitates the maintenance.

(2) A retainer retaining the bucket side load receiving section of the toggle plate and a retainer retaining the movable jaw teeth side load receiving section are fixed by tightening a bolt, wherein the pair of retainers and the toggle plate are removable by releasing the bolt tightening. Therefore, the movable jaw teeth side and bucket side load receiving sections of the toggle plate are fixed separately via bolts in a different manner from the conventional integrated model, and parts replacement can be accomplished simply, quickly, and easily.

(3) A wave-shaped teeth of the stationary jaw teeth and a wave-shaped teeth of the movable jaw teeth are formed in a vertically gentle arc shape, respectively, and the wave-shaped teeth of the stationary jaw teeth and the wave-shaped teeth of the movable jaw teeth are constructed in the same shape. Therefore, by forming the wavy teeth of the movable jaw teeth and the stationary jaw teeth vertically in the same arc shape and using the movable jaw teeth and the stationary jaw teeth arranged in a V shape, the gripping angle can be reduced, improving the performance in gripping the objects to be crushed, increasing the grinding length, and improving the crushing capability, and requiring only one piece of spare teeth plate.

(4) Provided is a tension device having a tension rod and a compression spring which elastically urge the bucket side load receiving section and the movable jaw teeth side load receiving section of the toggle plate respectively to always be in tight contact with the load faces of both the upper and lower ends of the toggle plate. Therefore, changes in the inclination of the tension rod can be automatically followed.

(5) The object to be crushed clogging a space between the movable jaw teeth and the stationary jaw teeth can be removed by reversely rotating the hydraulic motor to open the space between the movable jaw teeth and the stationary jaw teeth. Therefore, when the space between the movable jaw teeth and the stationary jaw teeth is clogged with the object to be crushed, if the hydraulic motor is reversely rotated in a state where an opening of the crusher is directed downward, the tip of the toggle plate, wherein the movable jaw teeth side load receiving section is placed at the upper position (in crushing state) than the bucket side load receiving section, descends, the space between the movable jaw teeth and the stationary jaw teeth is more easily increased, and the movable jaw teeth moves downwards, allowing quick removal of the object to be crushed from clogging the space between the movable jaw teeth and the stationary jaw teeth.

DESCRIPTION OF NUMERALS

| | |
|---|---|
| JC, JCB: | bucket type jaw crusher |
| 10: | bucket |
| 11: | bottom of bucket |
| 20, 20B: | stationary jaw teeth |
| 21, 21B: | wavy teeth of stationary jaw bucket |
| 30, 30B: | movable jaw teeth |
| 31, 31B: | wavy teeth of movable jaw teeth |
| 40: | eccentric main shaft |
| 42: | counterweight |
| 51, 51B: | toggle plate |
| 511, 511B: | upper load face |
| 512, 512B: | lower load face |
| 5101: | check valve |
| 5102, 5103: | grease supply hole |
| 52, 52B: | movable jaw teeth side load receiving section |
| 53, 53B: | bucket side load receiving section |
| 521, 531: | bolt |
| 55, 55B: | tension device |
| 551, 551B: | tension rod |
| 56, 56B: | compression spring |
| 571B, 581B: | concave receiving section |
| 572, 582, 572B, 582B: | D-shape pusher |
| 60: | hydraulic motor (rotational driving means) |
| 70: | flywheel |
| 80: | object to be crushed |

DESCRIPTION OF THE PREFERRED EMBODIMENT

Hereinafter, preferred embodiments of the present invention will be explained based on embodiments.

Embodiment 1

Figure 1:
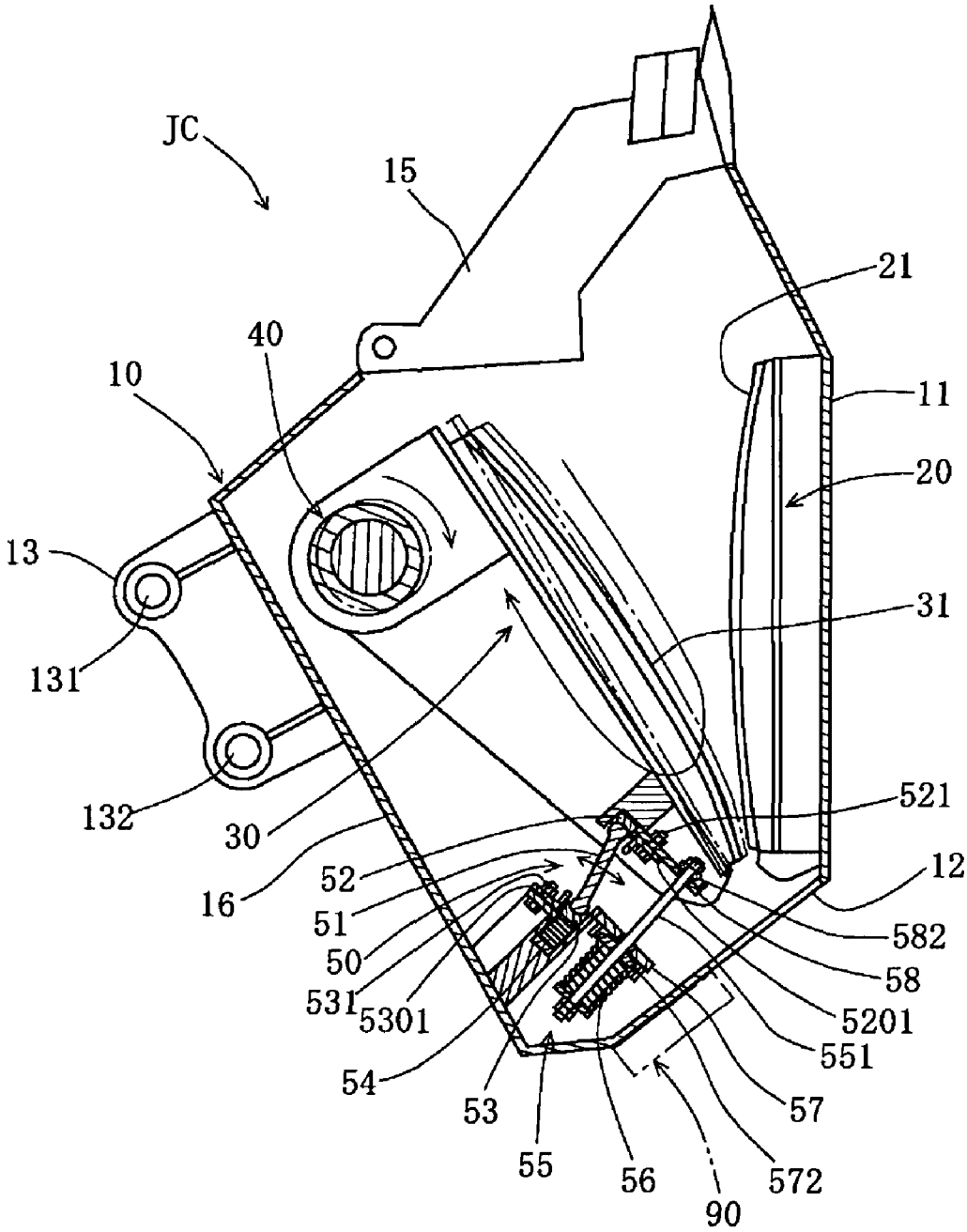
FIG. 1 is a cross-sectional view of a bucket type jaw crusher of embodiment 1 according to the present invention.

A bucket type jaw crusher JC of embodiment 1 is explained based on FIG. 1~FIG. 9. As shown in FIG. 1, the bucket type jaw crusher JC comprises a stationary jaw teeth 20, a movable jaw teeth 30, an eccentric main shaft 40, a toggle plate mechanism 50, and an electromagnet 90, and crushes an object to be crushed 80 by pressing it onto the stationary jaw teeth 30 with the movable jaw teeth 20 through the rocking motion of a toggle plate 51.

The stationary jaw teeth 20 comprises wavy teeth 21 with a plurality of mountains and valleys formed vertically in a gentle arc shape on the inner surface side and are fixed to the inner face of the bottom section 11 of bucket 10. The movable jaw teeth 30 has wavy teeth 31 with a plurality of mountains and valleys formed vertically in a gentle arc shape so as to engage with the wavy teeth 21 of the stationary jaw teeth 20 on the inner surface side. The wavy teeth 21 of the stationary jaw teeth 20 and the wavy teeth 31 of the movable jaw teeth 30 are constituted in the same shape if viewed from the side.

The top of the movable jaw teeth 30 is rotatably supported on the eccentric main shaft 40 via a pair of eccentric bearings 411, lower portion of the movable jaw teeth 30 is supported by the toggle plate 51 via a movable jaw teeth side load receiving section 52, arranged opposing the stationary jaw teeth 20 so as to form a V shape with the stationary jaw teeth with a small gripping angle of 7~8 degrees or smaller.

Figure 2:
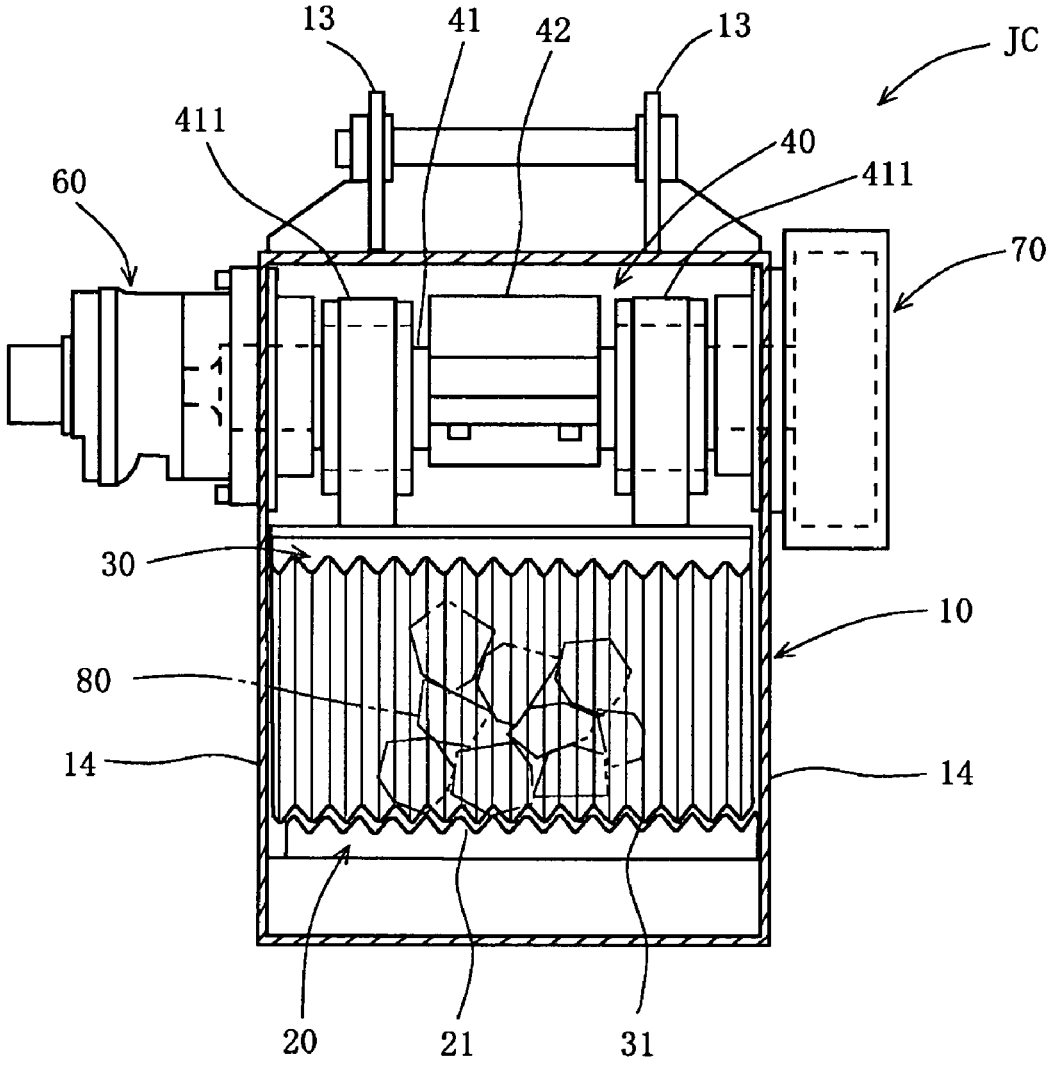
FIG. 2 is a cross-sectional view viewed from the opening in FIG. 1.
Figure 3:
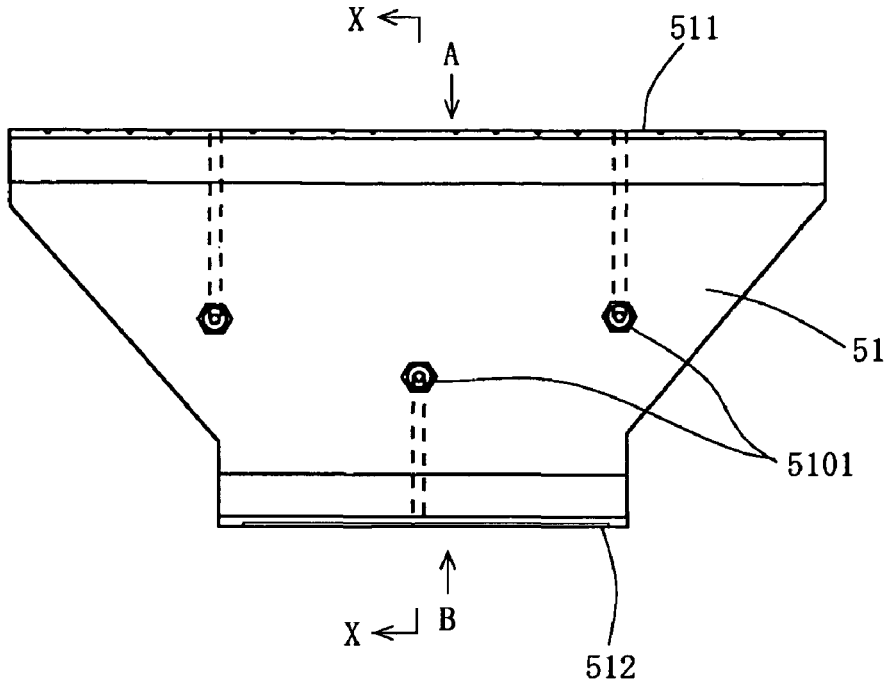
FIG. 3 is a front view of the toggle plate in FIG. 1.
Figure 4:
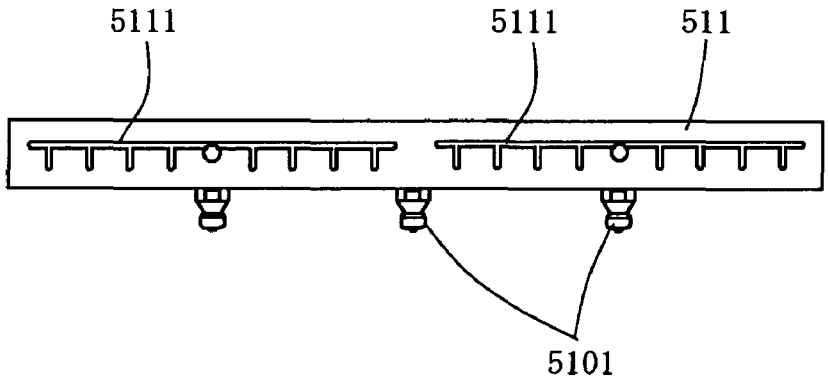
FIG. 4 is a plan view viewed from above FIG. 3.
Figure 5:
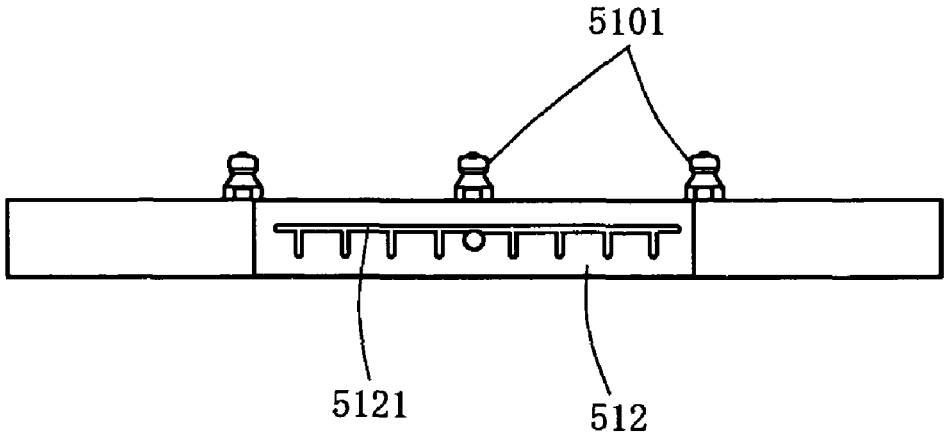
FIG. 5 is a plane view viewed from below FIG. 3.
Figure 6:
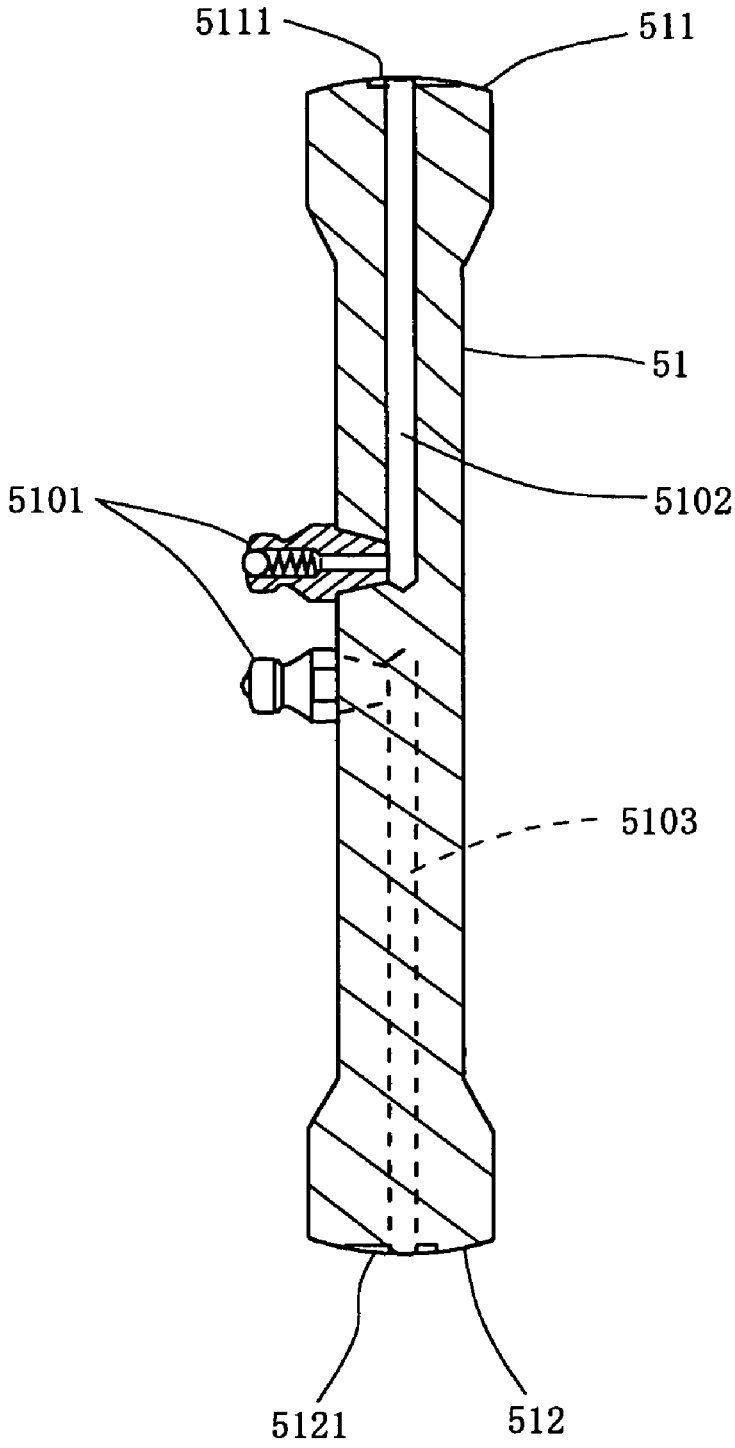
FIG. 6 is a cross-sectional view along X-X line in FIG. 3.

As shown in FIG. 2, the eccentric main shaft 40 penetrates the left and right plates 14 and 14 of the bucket 10 and is rotated by a rotational driving means. A hydraulic motor 60 is provided as the rotational driving means outside one side plate 14, wherein the hydraulic motor 60 is connected to an end of the eccentric main shaft 40, and a flywheel 70 is connected to the other end of the eccentric main shaft 40 outside the other side plate 14.

A counterweight 42 for balance adjustment is provided fixedly at an intermediate portion of the eccentric main shaft 40 between the hydraulic motor 60 and the flywheel 70. The counterweight 42 is attached to the eccentric main shaft 40 so that the weight center of the counterweight 42 comes above the eccentric main shaft 40 on the opposite side of the movable jaw teeth 30 when the movable jaw teeth 30 has descended in the reciprocating motion of the movable jaw teeth 30 and the weight center comes below the eccentric main shaft 40 on the side of the movable jaw teeth 30 when the movable jaw teeth 30 has ascended. In this manner, the counterweight 42 can balance the unbalance moment and inertial force exerted on the eccentric main shaft 40 when the movable jaw teeth reciprocates up and down, providing improvement on the crushing speed.

The toggle plate mechanism 50 comprises a toggle plate 51, a movable jaw teeth side load receiving section 52, a bucket side load receiving section 53, and a tension rod 551.

As shown in FIG. 3~FIG. 6, the toggle plate 51 has an upper load face 511 and a lower load face 512 with a convex partial cylindrical cross section on the top and bottom ends, and has grease supply holes 5102 and 5103 including respectively a check valve 5101, communicating from one surface to the upper load face 511 and the lower load face 512. Grease can be supplied from the grease supply holes 5102 and 5103 to the upper and lower load faces 511 and 512.

Provided on the upper load face 511 and the lower load face 512 are oil grooves 5111 and 5121 for dispersing supplied grease. Supplying grease to the toggle plate 51 can be accomplished directly by a grease gun to the toggle plate 51 via the check valves 5101, eliminating the need for a pump or piping and facilitating maintenance.

The movable jaw teeth side load receiving section 52 has its bottom face formed in a concave partial cylindrical shape in contact with the upper load face 511 of the toggle plate 51 and is tightened by a bolt 521 via a retainer 5201 to the lower portion of the movable jaw teeth 30. The bucket side load receiving section 53 has its top face in a concave partial cylindrical shape in contact with the lower load face 512 of the toggle plate 51 and is tightened by a bolt 531 via a retainer 5301 to the top plate 16 of the bucket 10 sandwiching adjusting plates 54. The pair of retainers 5201 and 5301 and the toggle plate 51 can be detached by releasing the tightening of the bolts 521 and 531. The movable jaw teeth side load receiving section 52 is placed at an upper position than the bucket side load receiving section 53.

The upper load face 511 of the toggle plate 51 is in contact with the movable jaw teeth side load receiving section 52, the lower load face 512 is in contact with the bucket side load receiving section 53, which are maintained in tight contact via a tension rod 551 and a compression sprint 56 so that the contact sections will not become detached. The toggle plate 51 is designed to be operated to press the movable jaw teeth 30 which reciprocates vertically by rotation of the eccentric main shaft 40 onto the stationary jaw teeth 20 sandwiching the object to be crushed 80 via the rocking motion of the toggle plate 51 by installing it with an upslope toward the eccentric main shaft 40 side from a plane which is perpendicular to the movable jaw teeth 30.

By adjusting the number of the adjusting plates 54 on the bottom of the load receiving section 53, the space between the bottom end of the movable jaw teeth 30 and the bottom end of the stationary jaw teeth 20 can be adjusted to adjust the crushing size of the object to be crushed 80. If the load receiving section 52 or the load receiving section 53 of the toggle plate 51 becomes worn out, the load receiving section 52 and the load receiving section 53 can be replaced by detaching the bolt 521 of the retainer 5201 and the bolt 531 of the retainer 5301, respectively.

The tension rod 551 is connected by a bolt with both ends threaded between a supporting plate 58 at the bottom end of the movable jaw teeth 30 and a supporting plate 57 on the opposite side of the retainer 5301 via a compression spring 56 and D-shape pushers 572 and 582. Constitution is such that tight contact can be constantly maintained between the upper load face 511 and the load receiving section 52 and between the lower load face 512 and the load receiving section 53 by elastic urging of a compression spring 56 and so that changes in the inclination angle of the tension rod 551 can be automatically followed by the exit space adjustment of the movable jaw teeth 30 and the reciprocating motion of the movable jaw teeth 30. The tension rod 551, the compression spring 56, and the D-shape pushers 572 and 582 correspond to the tension device 55.

The electromagnet 90 is formed in a rectangular shape and installed beside an exhaust port 12 on the lower part of the bucket 10 so that crushed scrap iron flowing down through the exhaust port 12 magnetically adheres to it. When the electromagnet 90 is used, the bucket 10 is moved to direct the electromagnet 90 toward the crushed object 80, the electromagnet 90 is operated, and scrap iron in the object to be crushed 80 is absorbed and removed.

The bucket type jaw crusher JC is attached to an arm 2 of a hydraulic shovel 1 wherein the object to be crushed 80 can be crushed with the movable jaw teeth 30 reciprocated via the eccentric main shaft 40 by a hydraulic motor 60 and the stationary jaw teeth 20.

Figure 7:
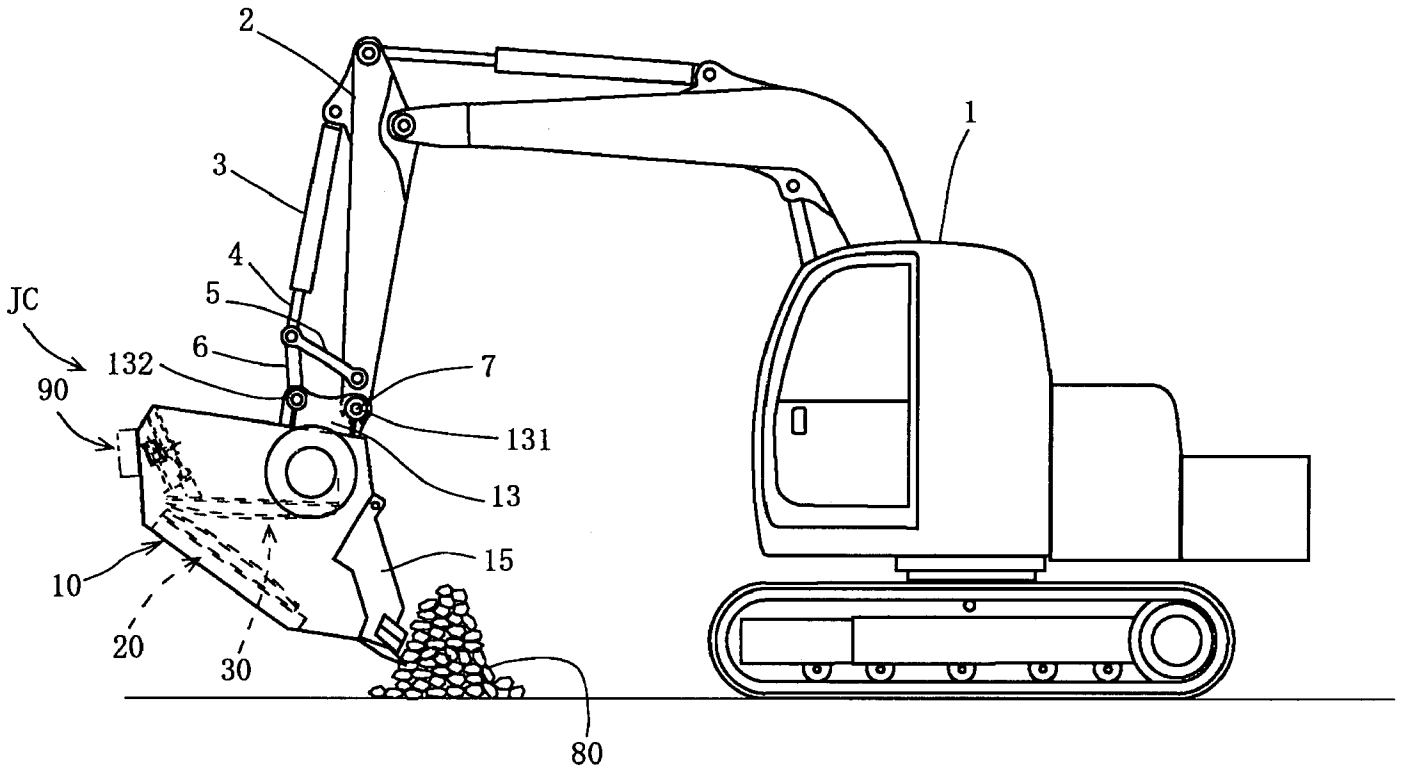
FIG. 7 is a side view showing a state of using the bucket type jaw crusher.
Figure 8:
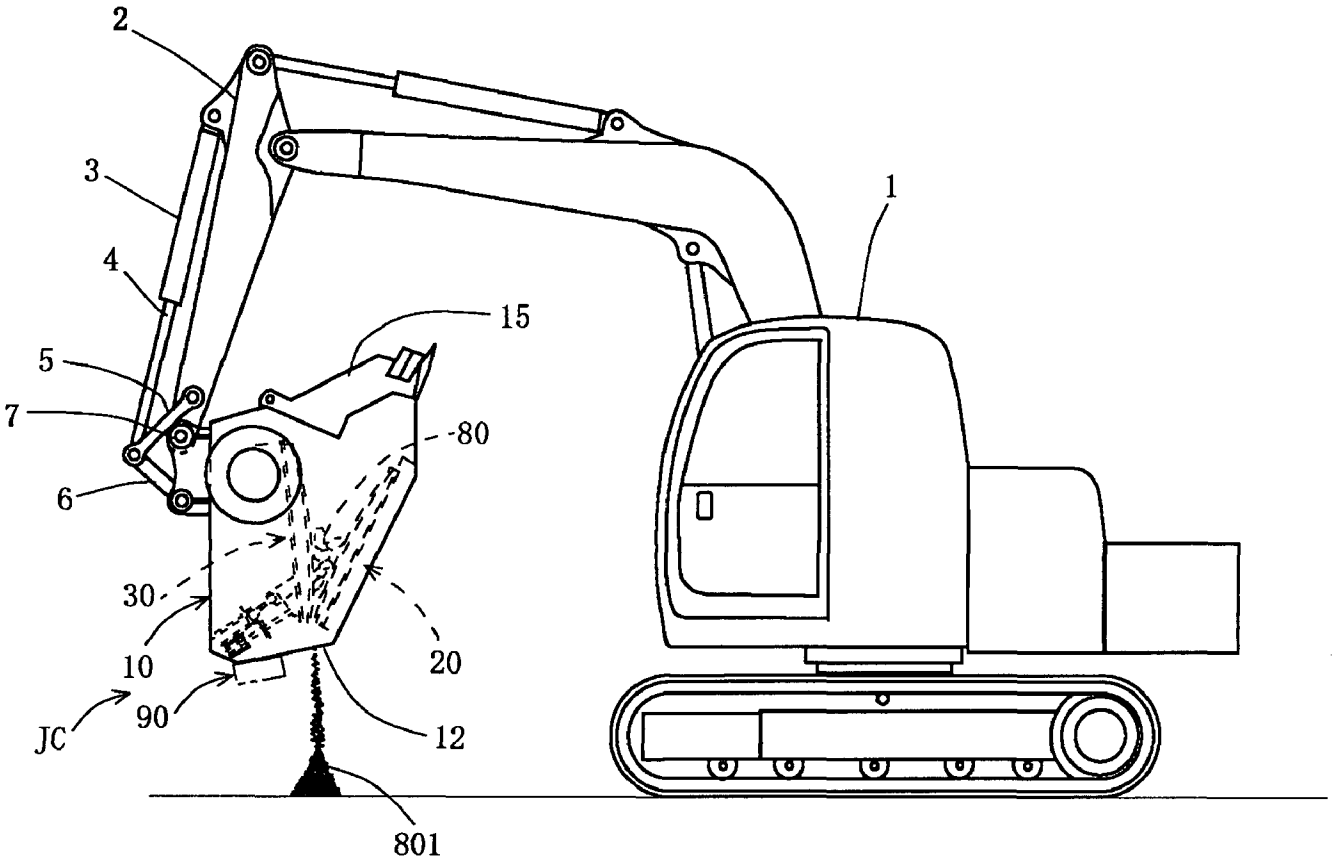
FIG. 8 is a side view showing another state of using the bucket type jaw crusher.

When the bucket type jaw crusher is attached to the hydraulic shovel 1, as shown in FIG. 7, a shaft hole 131 of a bracket 13 of the bucket 10 and a pin hole 7 on the tip of the arm 2 of the hydraulic shovel 1 are connected by a pin, and the other shaft hole 132 is axially connected by a pin to a rod 4 of a bucket cylinder 3 via an H-type link 6. First, an opening 15 of the bucket 10 is directed to the object to be crushed 80 to scoop the object to be crushed 80, next as shown in FIG. 8 the bucket 10 is moved upward to a place in which to accumulate the finely crushed object 80, the hydraulic motor 60 is driven to operate the movable jaw teeth 30, and the object to be crushed is finely crushed 801 and exhausted through the exhaust port 12 on the bottom of the bucket 10.

Figure 9:
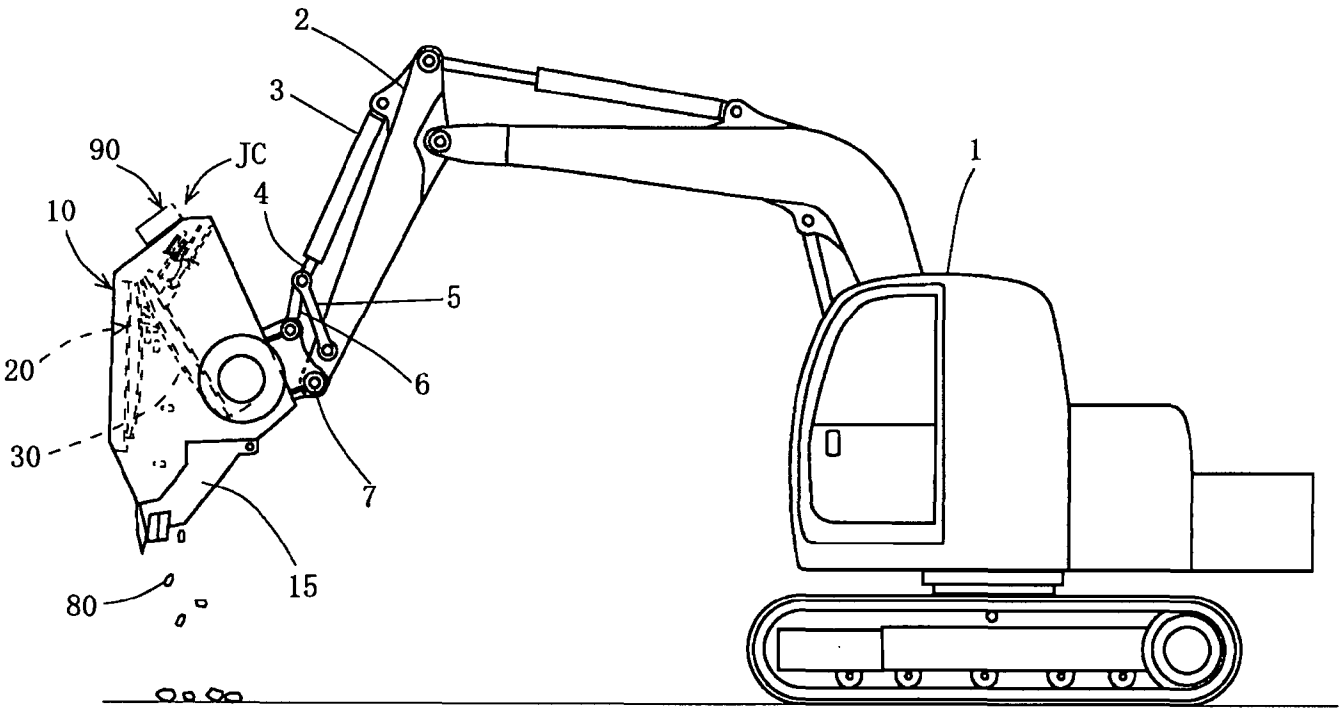
FIG. 9 is a side view showing yet another state of using the bucket type jaw crusher.
Figure 10:
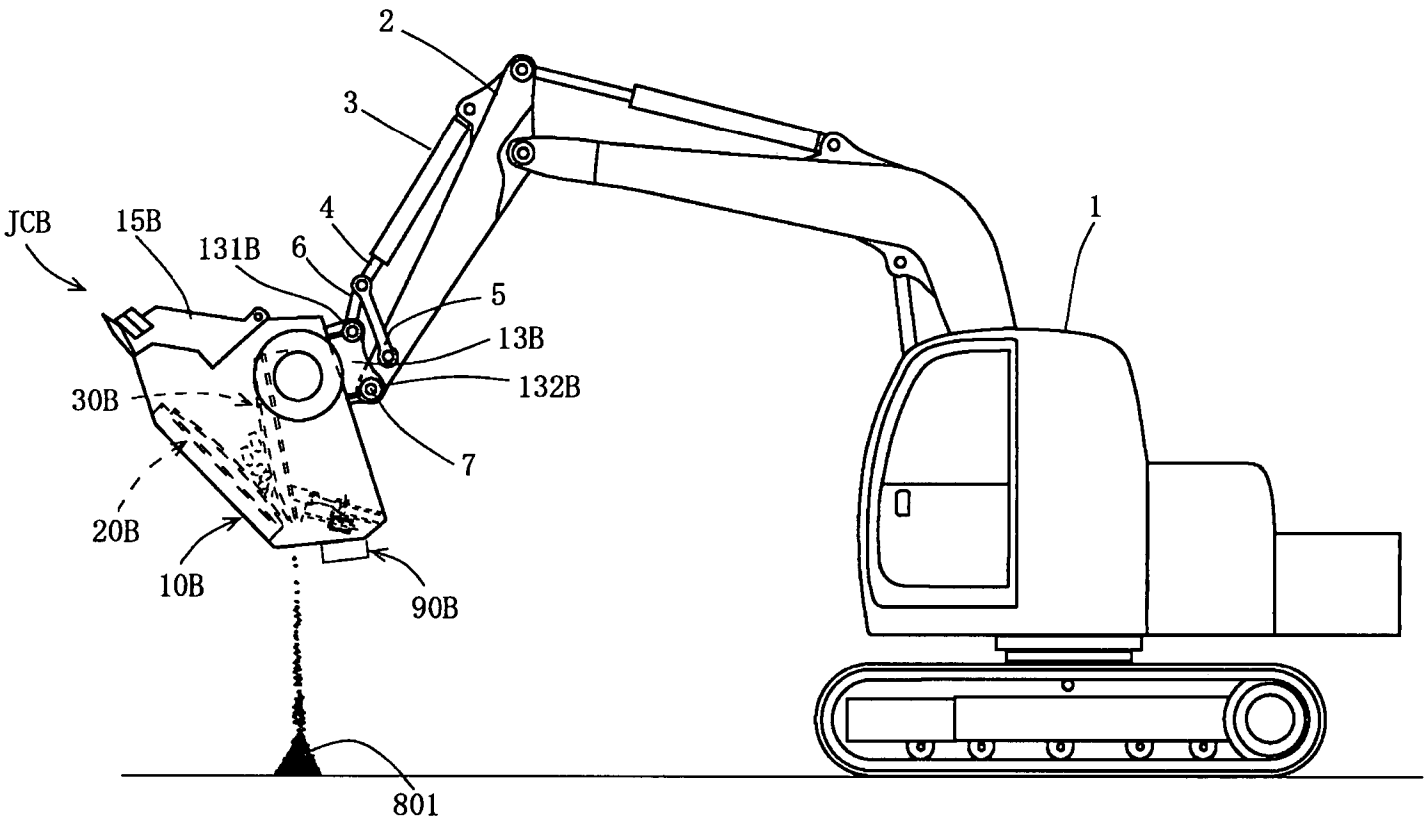
FIG. 10 is a side view showing a state of using the bucket type jaw crusher of embodiment 2.

If the space between the movable jaw teeth 30 and the stationary jaw teeth 20 is clogged with the object to be crushed 80, as shown in FIG. 9, an opening 15 of the bucket 10 is directed downward and the hydraulic motor 60 is reversely rotated to open the space between the movable jaw teeth 30 and the stationary jaw teeth 20, which lowers the tip of the toggle plate 51 installed down-sloped toward its tip and makes it easy to open the space between the bottom of the movable jaw teeth 30 and the stationary jaw teeth 20, and the movable jaw teeth 30 moves downward, thus removing the clogging of the object to be crushed 80.

Next, the advantages of the bucket type jaw crusher JC are explained.

In the bucket type jaw crusher JC of the present invention, while moving the movable jaw teeth 30 in the direction pressing down the object to be crushed 80 from the top, by arranging the toggle plate 51 which supports the bottom portion of the movable jaw teeth so that the movable jaw teeth side load receiving section 52 of the toggle plate 51 is placed at an upper position than the bucket side load receiving section 53 of the toggle plate 51 unlike the conventional case, receiving a reaction of the toggle plate 51 when it makes a rocking motion, the object to be crushed 80 can be crushed into fines. In addition, because the counterweight 42 is installed at the eccentric main shaft 40 between the hydraulic motor 60 and the flywheel 70, the crushing speed by eccentric rotation can be improved in a balanced manner and increased.

By using the stationary jaw teeth 20 and the movable jaw teeth 30 with wavy teeth 21 and 31 formed vertically in the same arc shape and arranging them in a V shape, the gripping angle is reduced, improving the gripping performance of the object to be crushed 80, increasing the grinding length, improving the crushing capability, requiring only one spare teeth plate. Because the load receiving section 53 can be partially replaced by removing the bolt 531 of the receiving retainer 5301, unlike the conventional integrated model, partial replacement can be accomplished simply, quickly, and easily.

D-type pushers 572 and 582 having at least a partial cylindrical convex face are attached to both ends of the tension rod 551, and even if the inclination of the tension rod 551 changes by the exit space adjustment and the reciprocating motion of the movable jaw teeth 30, the D-type pushers 571 and 582 perform rocking motions so that only a tensile force is applied to the tension rod 551, and the short tension rod 551 can be used to reduce the space.

Embodiment 2

A bucket type jaw crusher JCB is explained based on FIG. 10~FIG. 13. Since the same reference numerals are assigned to the same components as in Embodiment 1, the explanation thereof is omitted.

Figure 11:
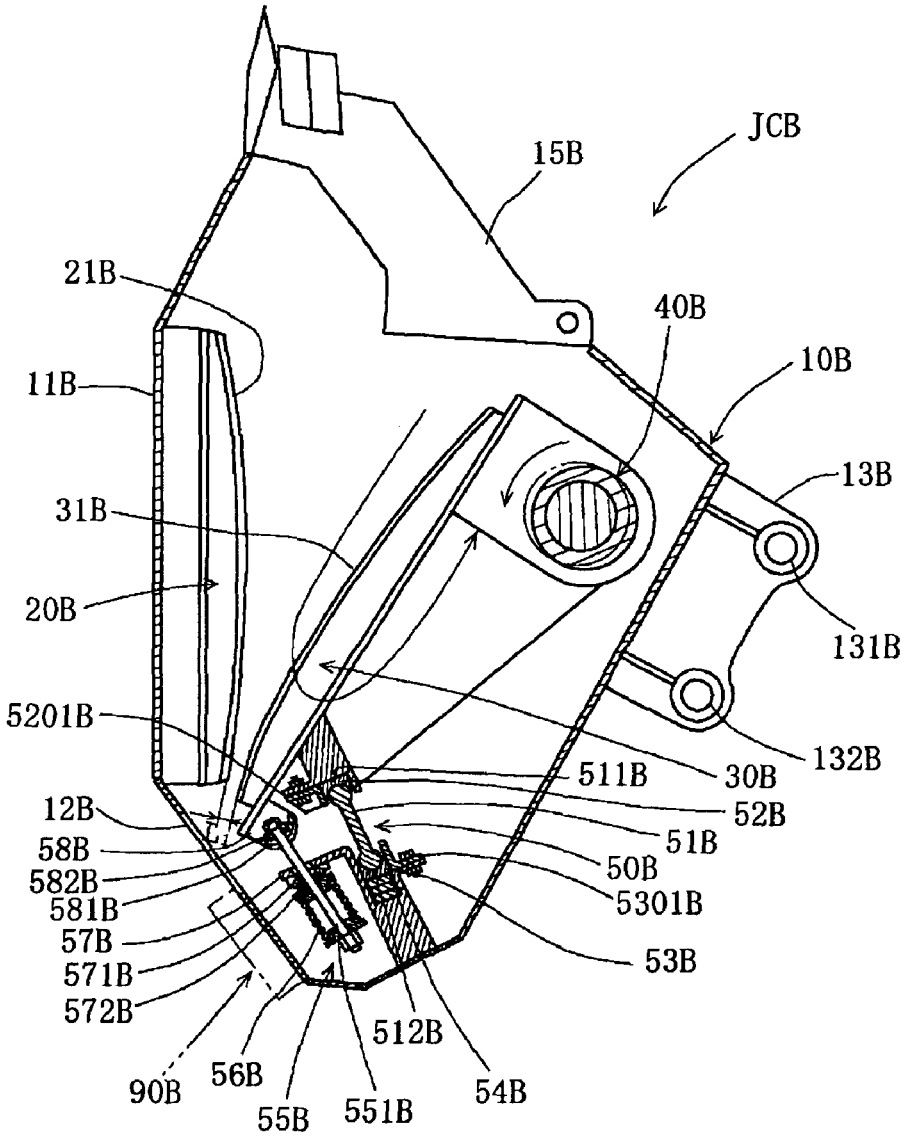
FIG. 11 is a cross-sectional view of the bucket type jaw crusher of FIG. 10.
Figure 12:
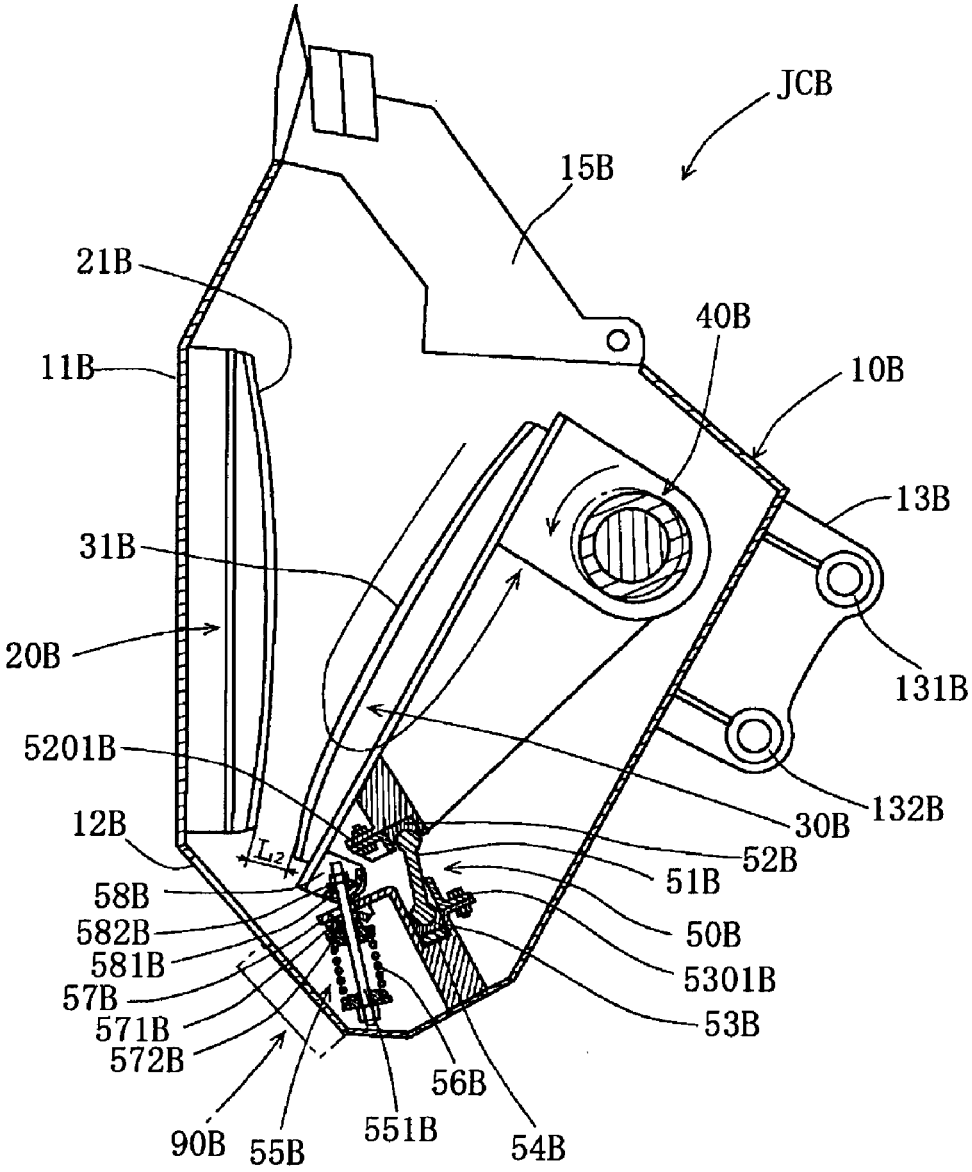
FIG. 12 is a cross-sectional view of the bucket type jaw crusher of FIG. 10.

As shown in FIG. 11 and FIG. 12, the bucket type jaw crusher JCB comprises a stationary jaw teeth 20B, a movable jaw teeth 30B, an eccentric main shaft 40B, a toggle plate unit 50B, and an electromagnet 90B. Because the constitution of the stationary jaw teeth 20, the movable jaw teeth 30B, the eccentric main shaft 40B, and the electromagnet 90B are the same as in Embodiment 1 of the present invention, the detailed explanation is omitted.

The toggle plate unit 50B comprises a toggle plate 51B, a movable jaw teeth side load receiving section 52B, a bucket side load receiving section 53B, and a tension rod 551B. Because the constitutions of the toggle plate 51B, the upper load receiving section 52B, and the lower load receiving section 53B are the same as in Embodiment 1, their explanation is omitted.

Figure 13:
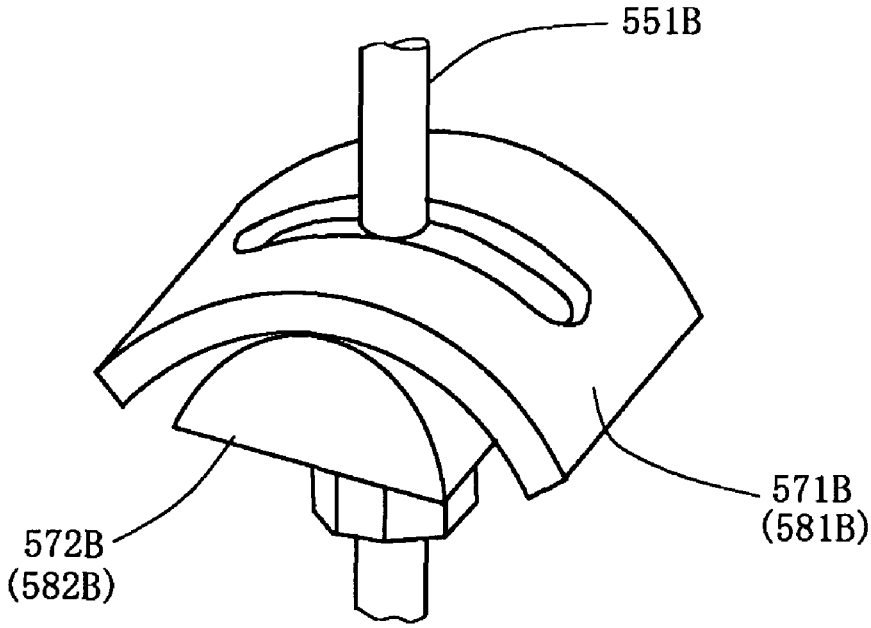
FIG. 13 is a perspective view of a tension rod, a concave receiving section, and a D-shape pusher.

The tension rod 551B is screwed with a bolt with both ends threaded between a supporting plate 58B at the bottom portion of the movable jaw teeth 30B and a supporting plate 57B on the opposite side of a retainer 5301B via a compression spring 56B and a composite seat combining concave receiving sections 571B and 581B having a small curvature and D-shape pushers 572B and 582B as shown in FIG. 11~FIG. 13, and is constituted so that tight contact can be constantly maintained between upper load face 511B and the load receiving section 52B and between a lower load face 512B and the load receiving section 53B.

In addition, when the exit space between the bottom portion of the movable jaw teeth 30B and the stationary jaw teeth 20B is adjusted for crushing size adjustment, as shown in FIG. 11, even if the inclination of the tension rod 551B when the exit space L1 is small changes when the exit space L2 is large as shown in FIG. 12, it can be automatically followed by rocking motions of the D-shape pushers 572B and 582B in concave receiving sections 571B and 581B of the composite seat.

When the bucket type jaw crusher JCB is attached to a hydraulic shovel 1, if a shaft hole 132B of a bracket 13B of a bucket 10B and a pin hole 7 on the tip of an arm 2 of the hydraulic shovel 1 are connected by a pin, and the other shaft hole 131B is axially connected by a pin to a rod 4 of a bucket cylinder 3 via an H-type link 6, an opening 15B of the bucket 10B can be set closer to an object to be crushed 80 in a place having a building or a wall in front. Because the actions of the eccentric main shaft 40B and the electromagnet 90B are the same as in Embodiment 1, their explanation is omitted.

The bucket type jaw crusher of the present invention is compact and lightweight, can be mass-produced, and can be easily attached to a hydraulic shovel to be used for various kinds of industrial purposes.

What is claimed is:

1. A bucket type jaw crusher for attaching to a hydraulic shovel arm, comprising: stationary jaw teeth fixed to an inner surface of a bottom of a bucket, movable jaw teeth opposing the stationary jaw teeth forming a V shape together with the stationary jaw teeth, a toggle plate supporting a lower portion of the movable jaw teeth, an eccentric main shaft rotatably supporting an upper portion of the movable jaw teeth, a rotational driving means which rotationally drives the eccentric main shaft, and is capable of crushing an object to be crushed with the movable jaw teeth reciprocated via the eccentric main shaft by the rotational driving means and the stationary jaw teeth;

said rotational driving means comprising a hydraulic motor connected to one end of the eccentric main shaft and a flywheel connected to the other end of the eccentric main shaft, a counterweight for balance adjustment at an intermediate portion of the eccentric main shaft between said hydraulic motor and said flywheel;

a movable jaw teeth side load receiving section of said toggle plate is placed at an upper position than a bucket side load receiving section of said toggle plate; and while the movable jaw teeth are reciprocated by the rotation of said eccentric main shaft, said object to be crushed is pressed against the stationary jaw teeth by the movable jaw teeth via the rocking motion of said toggle plate.

2. The bucket type jaw crusher according to claim 1, comprising a plurality of grease supply holes including check valves in said toggle plate, which respectively communicate with an upper end load surface and a lower end load surface of said toggle plate, so that grease can be supplied from the grease supply holes onto said upper and lower load faces.

3. The bucket type jaw crusher according to claim 2, comprising a retainer retaining said bucket side load receiving section of said toggle plate and a retainer retaining said movable jaw teeth side load receiving section are fixed by tightening a bolt, wherein said pair of retainers and said toggle plate are removable by releasing the bolt tightening.

4. The bucket type jaw crusher according to claim 1 comprising a retainer retaining said bucket side load receiving section of said toggle plate and a retainer retaining said movable jaw teeth side load receiving section are fixed by tightening a bolt, wherein said pair of retainers and said toggle plate are removable by releasing the bolt tightening.

5. The bucket type jaw crusher according to claim 1, wherein a wave-shaped teeth of said stationary jaw teeth and a wave-shaped teeth of said movable jaw teeth are formed in a vertically gentle arc shape, respectively, and said wave-shaped teeth of said stationary jaw teeth and said wave-shaped teeth of said movable jaw teeth are constructed in the same shape.

6. The bucket type jaw crusher according to claim 5, wherein a wave-shaped teeth of said stationary jaw teeth and a wave-shaped teeth of said movable jaw teeth are formed in a vertically gentle arc shape, respectively, and said wave-shaped teeth of said stationary jaw teeth and said wave-shaped teeth of said movable jaw teeth are constructed in the same shape.

7. The bucket type jaw crusher according to claim 1, comprising a tension device having a tension rod and a compression spring which elastically urge said bucket side load receiving section and said movable jaw teeth side load receiving section of said toggle plate respectively to always be in tight contact with said load faces of both said upper and lower ends of said toggle plate.

8. The bucket type jaw crusher according to claim 7, comprising a tension device having a tension rod and a compression spring which elastically urge said bucket side load receiving section and said movable jaw teeth side load receiving section of said toggle plate respectively to always be in tight contact with said load faces of both said upper and lower ends of said toggle plate.

9. The bucket type jaw crusher according to claim 1, wherein said object to be crushed clogging a space between said movable jaw teeth and said stationary jaw teeth can be removed by reversely rotating the hydraulic motor to open said space between said movable jaw teeth and said stationary jaw teeth.

10. The bucket type jaw crusher according to claim 9, wherein said object to be crushed clogging a space between said movable jaw teeth and said stationary jaw teeth can be removed by reversely rotating the hydraulic motor to open said space between said movable jaw teeth and said stationary jaw teeth.

* * * * *